US005101625A

United States Patent [19]

Sugino et al.

[11] Patent Number: 5,101,625

[45] Date of Patent: Apr. 7, 1992

[54] APPARATUS FOR CONTROLLING AIR-FUEL RATIO USING AIR-FUEL RATIO SENSOR ASSOCIATED WITH HEATER

[75] Inventors: Tadashi Sugino, Toyota; Michio Furuhashi, Susono; Noriaki Kurita, Nagoya, all of Japan

[73] Assignee: Nippondenso Co., Ltd., Kariya, Japan

[21] Appl. No.: 615,698

[22] Filed: Nov. 5, 1990

[30] Foreign Application Priority Data

Nov. 6, 1989 [JP] Japan ..... 1-287439

[51] Int. Cl.[5] ..... F01N 2/28

[52] U.S. Cl. ..... 60/276

[58] Field of Search ..... 60/274, 276

[56] References Cited

U.S. PATENT DOCUMENTS 4,130,095 12/1978 Bowler ..... 60/276
4,228,128 10/1980 Esper ..... 60/276
4,622,809 11/1986 Abthoff ..... 60/276
4,708,777 11/1987 Kuraoka ..... 60/276

FOREIGN PATENT DOCUMENTS 57-197459 12/1982 Japan .
60-214251 10/1985 Japan .
1-147138 6/1989 Japan .

*Primary Examiner*—Douglas Hart
*Attorney, Agent, or Firm*—Cushman, Darby & Cushman

[57] ABSTRACT

In an apparatus for controlling an air-fuel ratio in an internal combustion engine, a main air-fuel ratio sensor having an element temperature strongly affected by the temperature thereof, a sub air-fuel ration sensor having an element temperature weakly affected by the temperature thereof, and a heater associated with the main air-fuel ratio sensor are provided. The resistance value or electric power of the heater is controlled in accordance with the output of the sub air-fuel ratio sensor.

12 Claims, 17 Drawing Sheets

Fig. 15
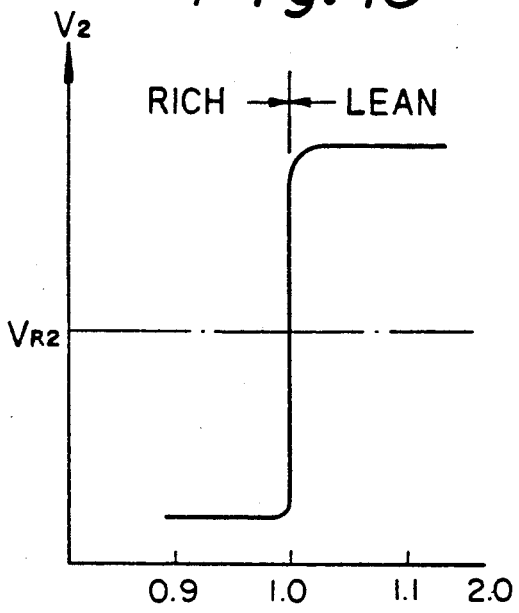
Fig. 17A
Fig. 17B
Fig. 17C
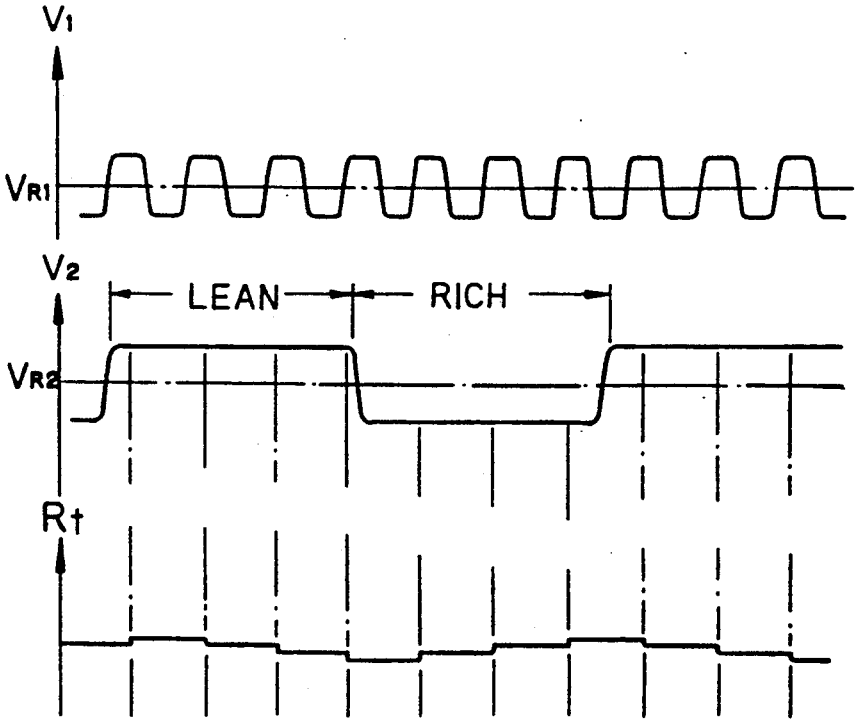

APPARATUS FOR CONTROLLING AIR-FUEL RATIO USING AIR-FUEL RATIO SENSOR ASSOCIATED WITH HEATER

BACKGROUND OF THE INVENTION

1. Field of the Invention

The present invention relates to an apparatus for controlling an air-fuel ratio in an internal combustion engine using an air-fuel ratio sensor such as a titania ($TiO_2$) type $O_2$ sensor associated with an electric heater, and more particularly, to controlling the power supplied to the heater.

2. Description of the Related Art

Generally, in a feedback control of the air-fuel ratio sensor ($O_2$ sensor) system, a base fuel amount TAUP is calculated in accordance with the detected intake air amount and detected engine speed and the base fuel amount TAUP is corrected by an air-fuel ratio correction coefficient FAF which is calculated in accordance with the output of an air-fuel ratio sensor (for example, an $O_2$ sensor) for detecting the concentration of a specific component such as the oxygen component in the exhaust gas. Thus, an actual fuel amount is controlled in accordance with the corrected fuel amount. The above-mentioned process is repeated so that the air-fuel ratio of the engine is brought close to a stoichiometric air-fuel ratio.

According to this feedback control, the center of the controlled air-fuel ratio can be within a very small range of air-fuel ratios around the stoichiometric ratio required for three-way reducing an oxidizing catalysts (catalyst converter) which can remove three pollutants CO, HC, and $NO_x$ simultaneously from the exhaust gas.

As the above-mentioned $O_2$ sensor, a titania ($TiO_2$) type $O_2$ sensor having a high response characteristic is used. Namely, the element resistance of the titania $O_2$ sensor is small when the air-fuel ratio is rich, and is large when the air-fuel ratio is lean. The element resistance of the titania type $O_2$ sensor, however, is affected strongly by the temperature thereof, compared with zirconia type $O_2$ sensors; i.e., when the temperature of the titania type $O_2$ sensor is increased, an output thereof indicating a lean state is close to that indicating a rich state, and as a result when the above-mentioned air-fuel ratio feedback control is carried out, the controlled air-fuel ratio may be overlean, thus increasing $NO_x$ emissions, and inviting knocking, misfiring, and the like. Therefore, it is important to maintain the titania type $O_2$ sensor at a high predetermined temperature. Note, such a high temperature state can be detected by incorporating a temperature sensor but this increases the manufacturing cost.

In a prior art, an electric heater is incorporated into an $O_2$ sensor, and the resistance value of the electric heater is controlled to a definite value (see JP-A-57-197459). Namely, since the temperature of the heater has a definite relationship to the resistance value thereof, and the element temperature of the $O_2$ sensor also has a definite relationship to the temperature of the heater, the element temperature of the $O_2$ sensor can be made definite by making the resistance value of the heater definite. Therefore, in this prior art, a supply power supplied to the heater is controlled so that the resistance value of the heater is brought close to a definite value, to thereby keep the element temperature of the $O_2$ sensor at a definite value.

On the other hand, when the driving state of the engine is determined, a supply of power to the heater required to maintain the temperature of the heater at a definite value is also determined. Thus, in another prior art (see JP-A-60-214251), an aimed supply power is first experimentally obtained for predetermined driving parameters of the engine, and the actual supply of power to the heater is controlled so that the actual power supplied is brought close to the aimed power supplied for the predetermined driving parameters of the engine.

In the above-mentioned prior art, the element temperature of the $O_2$ sensor can be maintained at a definite value while the engine is in a steady state, but when a transient state such as an acceleration state or a deceleration state of the engine occurs, it is impossible to maintain the element temperature of the $O_2$ sensor at the definite value for some time after the transient state, and thus a deviation of the controlled air-fuel ratio from the predetermined air-fuel ratio such as the stoichiometric air-fuel ratio occurs, to thereby increase the HC, CO, and $NO_x$ emissions. Also, it is impossible to maintain the element temperature of the $O_2$ sensor at the definite value after the elapse of a long time, thus also causing a deviation of the controlled air-fuel ratio from the predetermined air-fuel ratio. Further, even when the element temperature of the $O_2$ sensor can be maintained at the definite value, the resistance value thereof per se may be changed, and thus a deviation of the controlled air-fuel ratio from the predetermined air-fuel ratio occurs.

SUMMARY OF THE INVENTION

An object of the present invention is to provide an air-fuel ratio feedback control apparatus using an air-fuel ratio sensor incorporating an electric heater, by which an aimed air-fuel ratio is obtained.

According to the present invention, in an apparatus for controlling an air-fuel ratio in an internal combustion engine, in addition to a main air-fuel ratio sensor having an electric heater, a sub air-fuel ratio sensor is provided downstream of a catalyst converter. The resistance value or electric power of the heater is controlled in accordance with the output of the sub air-fuel ratio sensor.

BRIEF DESCRIPTION OF THE DRAWINGS

The present invention will be more clearly understood from the description as set forth below with reference to the accompanying drawings, wherein:

FIG. 15 is a graph showing the output characteristics of the sub $O_2$ sensor of FIG. 1;

FIGS. 17A, 17B, and 17C are timing diagrams explaining the flow chart of FIG. 15;

DESCRIPTION OF THE PREFERRED EMBODIMENTS

Figure 1:
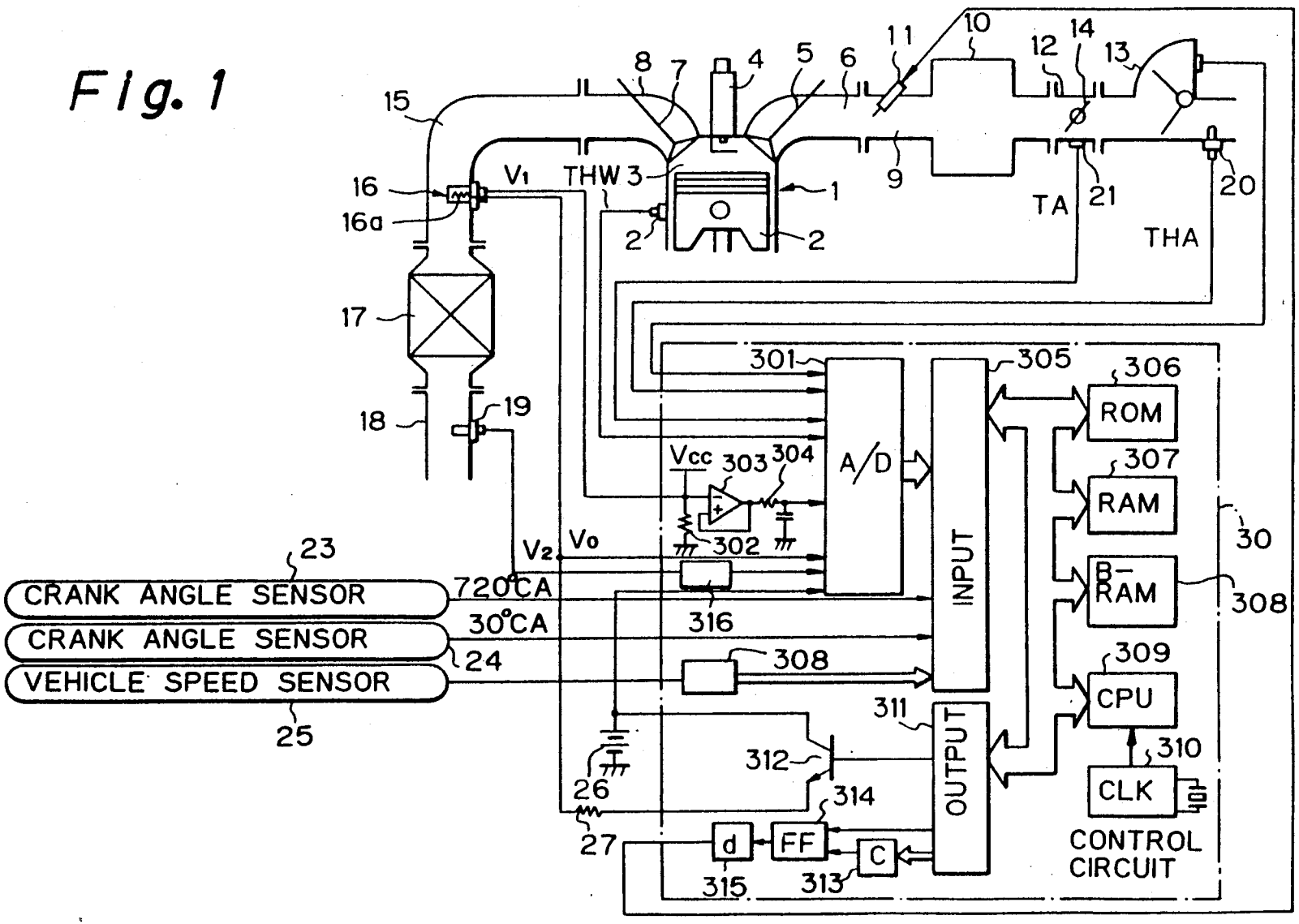
FIG. 1 is a schematic view of an internal combustion engine according to the present invention.

In FIG. 1, which illustrates an internal combustion engine according to the present invention, reference numeral 1 designates a four-cycle spark ignition engine disposed in an automotive vehicle. Reference 2 designates a piston, 3 a combustion chamber, 4 an ignition spark plug, 5 an air intake valve, 6 an air intake port, 7 an exhaust gas valve, and 8 an exhaust port. The air intake port 6 is clinked via a manifold pipe 9 to a surge tank 10.

Additionally provided in the air intake port 6 is a fuel injection valve 11 for supplying pressurized fuel from the fuel system to the air intake port of the cylinder of the engine 1. In this case, other fuel injection valves are also provided for other cylinders, but are not shown in FIG. 1.

The surge tank 10 is linked via an air intake duct 12 and an airflow meter 13 to an air cleaner (not shown). This airflow meter 13 is a potentio-meter type which detects the amount of air drawn into the engine 1 and generates an analog voltage signal in proportion to the amount of air flowing therethrough. The signal of the airflow meter 13 is transmitted to a multiplexer-incorporating analog-to-digital (A/D) converter 301 of a control circuit 30.

The exhaust gas port 8 is connected to an exhaust gas manifold 15. Provided in the exhaust gas manifold 15 is a titania type main $O_2$ sensor 16 for detecting the concentration of oxygen composition is the exhaust gas. The main $O_2$ sensor 16 generates an output voltage signal and transmits the signal via an input circuit to the A/D converter 101 of the control circuit 10. The input circuit is formed by a reference resistor 302 having a value $R_C$ of, for example, 50 kΩ, a voltage buffer 303, and an integration circuit 304. Also, to operate the main $O_2$ sensor 16 within a desired temperature range, a heater 16*a* is incorporated thereinto. The heater 16*a* is controlled by a driver circuit (transistor) 312 of the control circuit 10.

Provided downstream of an exhaust manifold 15 is a three-way reducing and oxidizing catalyst converter 17 which removes three pollutants CO, HC, and $NO_x$ simultaneously from the exhaust gas. This catalyst converter 17 is connected to an exhaust gas pipe 18. Also, provided in the exhaust gas pipe 18 is a zirconia type sub $O_2$ sensor 19 for detecting the concentration of oxygen composition in the exhaust gas. This sub $O_2$ sensor 19 generates an output voltage signal and transmits that signal via an input circuit 313 to the A/D concerter 301 of the control circuit 30. Note that this input circuit 313 has the configuration similar to the elements 302, 303, and 304.

Provided in the intake air duct 12 is an intake air temperature sensor 20 for detecting the temperature of the intake air. This sensor 20 generates an output voltage in response to the temperature of intake air and transmits that voltage to the A/D converter 301 of the control circuit 30.

Reference 21 designates a throttle sensor for detecting the opening TA of the throttle 14. Also, reference 22 designates a coolant temperature sensor for detecting the temperature of the coolant. The output voltage signals of the sensors 21 and 22 are also supplied to the A/D converter 301 of the control circuit 30.

Disposed in a distributor (not shown) are crank angle sensors 23 and 24 for detecting the angle of the crankshaft (not shown) of the engine 1. In this case, the crank angle sensor 23 generates a pulse signal at every 720° crank angle (CA) and the crank-angle sensor 24 generates a pulse signal at every 30° CA. The pulse signals of the crank angle sensors 23 and 24 are supplied to an input interface 305 of the control circuit 30. In addition, the pulse signal of the crank angle sensor 24 is then supplied to an interruption terminal of a central processing unit (CPU) 309.

Reference 25 designates a vehicle speed sensor which generates a pulse signal in proportion to the vehicle speed SPD and transmits that signal via a vehicle speed generating circuit 308 to the input interface 301.

Reference 26 designates a battery having a voltage $V_B$ of, for example, about 12 V. This voltage $V_B$ is supplied to the driver circuit 312 and the A/D converter 301 of the control circuit 30.

Reference 27 designates a resistor for detecting the resistance value of the heater 16*a*. The potential at the connection of the heater 16*a* and the resistor 27 is supplied to the A/D converter 301 of the control circuit 30.

The control circuit 30, which may be constructed by a microcomputer, further comprises, a read-only memory (ROM) 306 for storing a main routine and interrupt routines such as a fuel injection routine, an ignition timing routine, tables (maps), constants, etc., a random access memory 307 (RAM) for storing temporary data, a backup RAM 308, a clock generator 310 for generating various clock signals, a down counter 313, a flip-flop 314, a driver circuit 315, and the like.

Note that the battery 26 is connected via a connection (not shown) directly to the backup RAM 308 and, therefore, the content of the backup RAM is not erased even when the ignition switch (not shown) is turned OFF.

The down counter 313, the flip-flop 314, and the drive circuit 315 are used for controlling the fuel injection valve 11. That is, when a fuel injection amount TAU is calculated, which will be later explained, the amount TAU is preset in the down counter 318, and simultaneously the flip-flop 314 is set. As a result, the driver circuit 315 initiates the activation of the fuel injection valve 11. On the other hand, the down counter 313 counts up the clock signal from the clock generator 310, and finally generates a logic "1" signal from the borrow-out terminal of the down counter 313, to reset the flip-flop 314, so that the driver circuit 315 stops the activation of the fuel injection valve 11. Thus, an amount of fuel corresponding to the fuel injection amount TAU is injected into the fuel injection valve 11.

Interruptions occur at the CPU 103 when the A/D converter 101 completes an A/D conversion and generates an interrupt signal; when the crank angle sensor 25 generates a pulse signal; and when the clock generator 310 generates a special clock signal.

The intake air amount data Q of the airflow meter 13, the intake air temperature THA of the intake air temperature sensor 20, the opening angle TA of the throttle sensor 21, and the coolant temperature data THW of the coolant sensor 22 are fetched by an A/D conversion routine(s) executed at predetermined intervals, and then stored in the RAM 307. That is, the data Q, THA, TA, and THW in the RAM 307 are renewed at predetermined intervals. The engine speed Ne is calculated by an interrupt routine executed at 30° CA., i.e., at every pulse signal of the crank angle sensor 24, and is then stored in the RAM 307.

Figure 2:
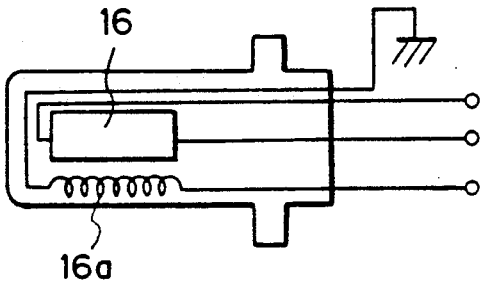
FIG. 2 is a schematic view of the main $O_2$ sensor of FIG. 1.

As illustrated in FIG. 2, the electric heater 16*a* is close to the element of the main $O_2$ sensor 16, thus improving the efficiency of the heating of the main $O_2$ sensor 16.

The characteristics of the main $O_2$ sensor 16 of the titania type will be explained with reference to FIGS. 3, 4, and 5.

Figure 3:
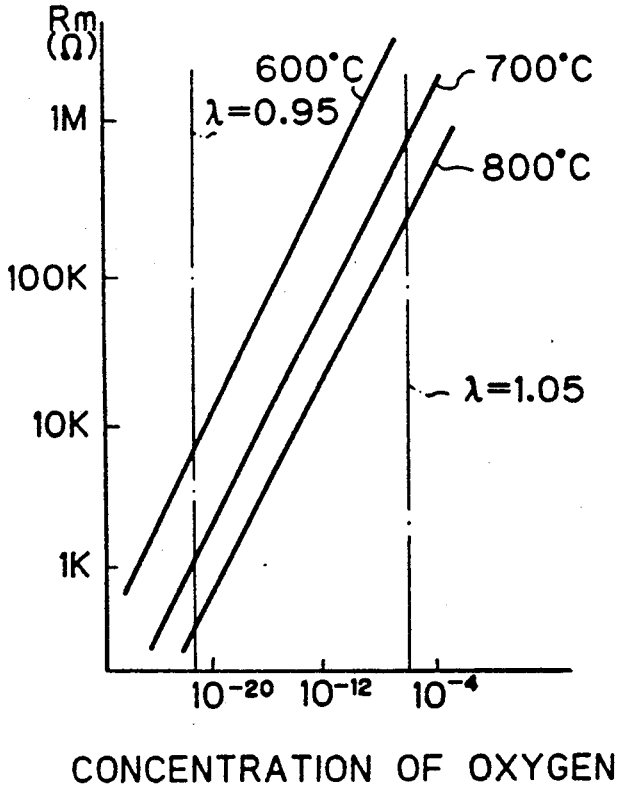
FIG. 3 is a graph showing the resistance value of the main $O_2$ sensor of FIG. 1 and the concentration of oxygen.

As illustrated in FIG. 3, which is a graph showing the resistance value $R_m$ of the main $O_2$ sensor 16 and the concentration of oxygen, even if the concentration of oxygen is definite, the resistance value $R_m$ of the main $O_2$ sensor 16 undergoes a remarkable change when the element temperature of the main $O_2$ sensor 16 is changed.

Figure 4:
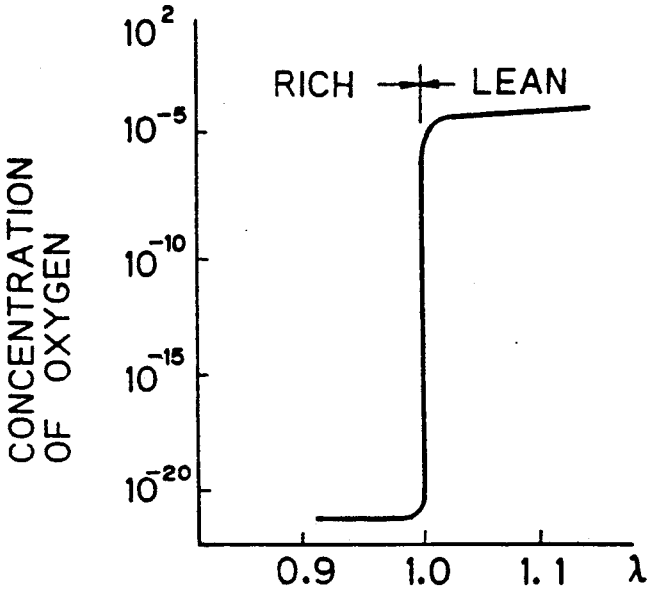
FIG. 4 is a graph showing the concentration of oxygen and the air-fuel ratio.

Also, as illustrated in FIG. 4, which is a graph showing the concentration of oxygen and the controlled air-fuel ratio λ, when the air-fuel ratio λ is smaller than 1.0, i.e., a rich air-fuel ratio state exists, the concentration of oxygen is extremely small.

Contrary to this, when the air-fuel ratio λ is larger than 1.0, i.e., a lean air-fuel ratio state exists, the concentration of oxygen is very large.

Figure 5:
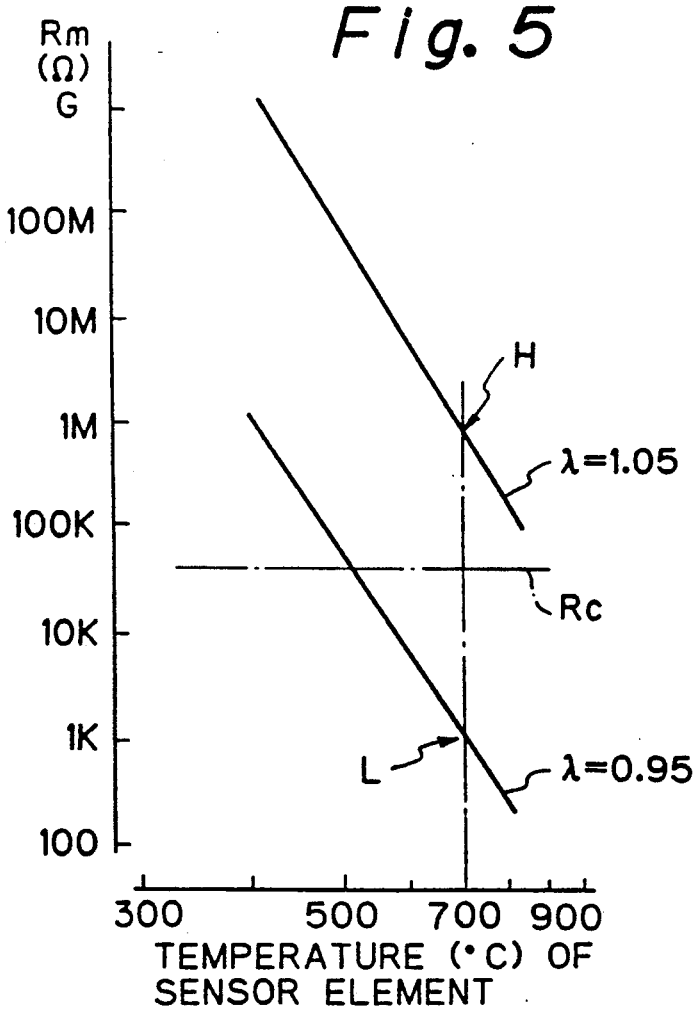
FIG. 5 is a graph showing the resistance value of the main $O_2$ sensor and the temperature of the main $O_2$ sensor.

The characteristics of FIG. 3 can be replaced by those of FIG. 5.

Figure 6:
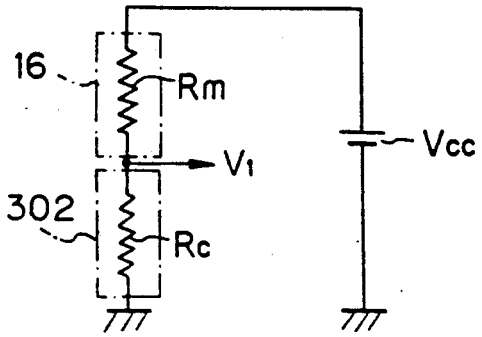
FIG. 6 is a circuit diagram of the main $O_2$ sensor of FIG. 1.

If the resistance value of the main $O_2$ sensor 16 is denoted by $R_m$, and the resistance value of the reference resistor 302 is denoted by $R_C$ as illustrated by FIG. 6, the output voltage $V_1$ of the main $O_2$ sensor 13 is represented by $$V_1 = V_{CC} \times \frac{R_C}{R_m + R_C}$$

where $V_{CC}$ is a power supply voltage such as 5 V. As illustrated in FIG. 5, when the air-fuel ratio is rich, the resistance value $R_m$ of the main $O_2$ sensor 16 is lowered to increase the output $V_1$ thereof. Conversely, when the air-fuel ratio is lean, the resistance value $R_m$ of the main $O_2$ sensor 16 is increased to reduce the output $V_1$ thereof. Also, the resistance value $R_m$ of the $O_2$ sensor 16, which in this case is a titania type, is affected strongly by the temperature thereof. Therefore, it is necessary to correct the output $V_1$ of the main $O_2$ sensor 16 by changing the element temperature thereof. For example, a reference voltage $V_{R1}$ is defined by $$V_{R1} = V_{CC}/2.$$

This corresponds to the condition $R_m = R_C$ in FIG. 5. In this case, ideally the element temperature of the main $O_2$ sensor 16 is maintained as is because the value $V_m = V_C$ is a center value between a resistance value $V_m = H$ at a lean air-fuel ratio $\lambda = 1.05$ and a resistance value $V_m = L$ at a rich air-fuel ratio $\lambda = 0.95$.

In FIG. 5, for example, when the main $O_2$ sensor 16 is at a high temperature such as 900° C., the output $V_1$ is higher than the reference voltage $V_{R1}$ even when the air-fuel ratio is actually lean, and as a result, the air-fuel ratio is erroneously determined to be rich, and accordingly, when the air-fuel ratio feedback control using the erroneously determined rich output $V_1$ is carried out, the controlled air-fuel ratio is overlean, thus increasing $NO_x$ emissions and inviting knocking, misfiring and the like. Conversely, when the main $O_2$ sensor 16 is at a low temperature such as 500° C., the output $V_1$ is lower than the reference voltage $V_{R1}$ even when the air-fuel ratio is actually rich, and as a result, the air-fuel ratio is erroneously determined to be lean, and accordingly, when the air-fuel ratio feedback control using the erroneously determined lean output $V_1$ is carried out, the controlled air-fuel ratio is overrich, thus increasing HC and CO emissions.

Figure 8A:
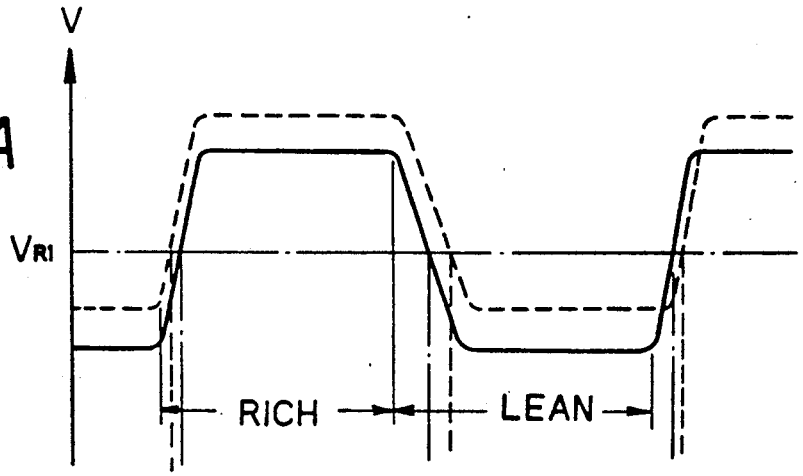
FIGS. 8A and 8B are timing diagrams explaining the flow chart of FIG. 7.
Figure 8B:
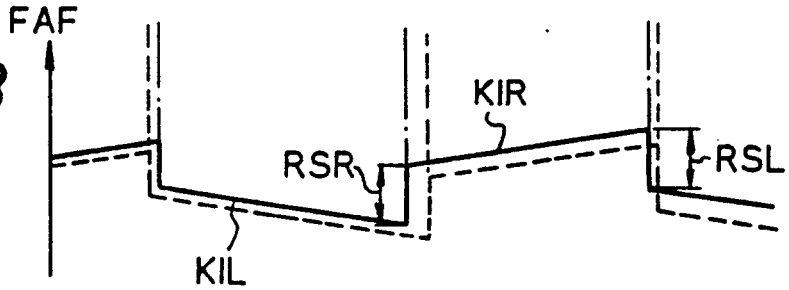

Note that the air-fuel ratio feedback control will be explained with reference to FIGS. 7, 8A, and 8B.

The operation of the control circuit 30 according to the present invention will be explained.

Figure 7:
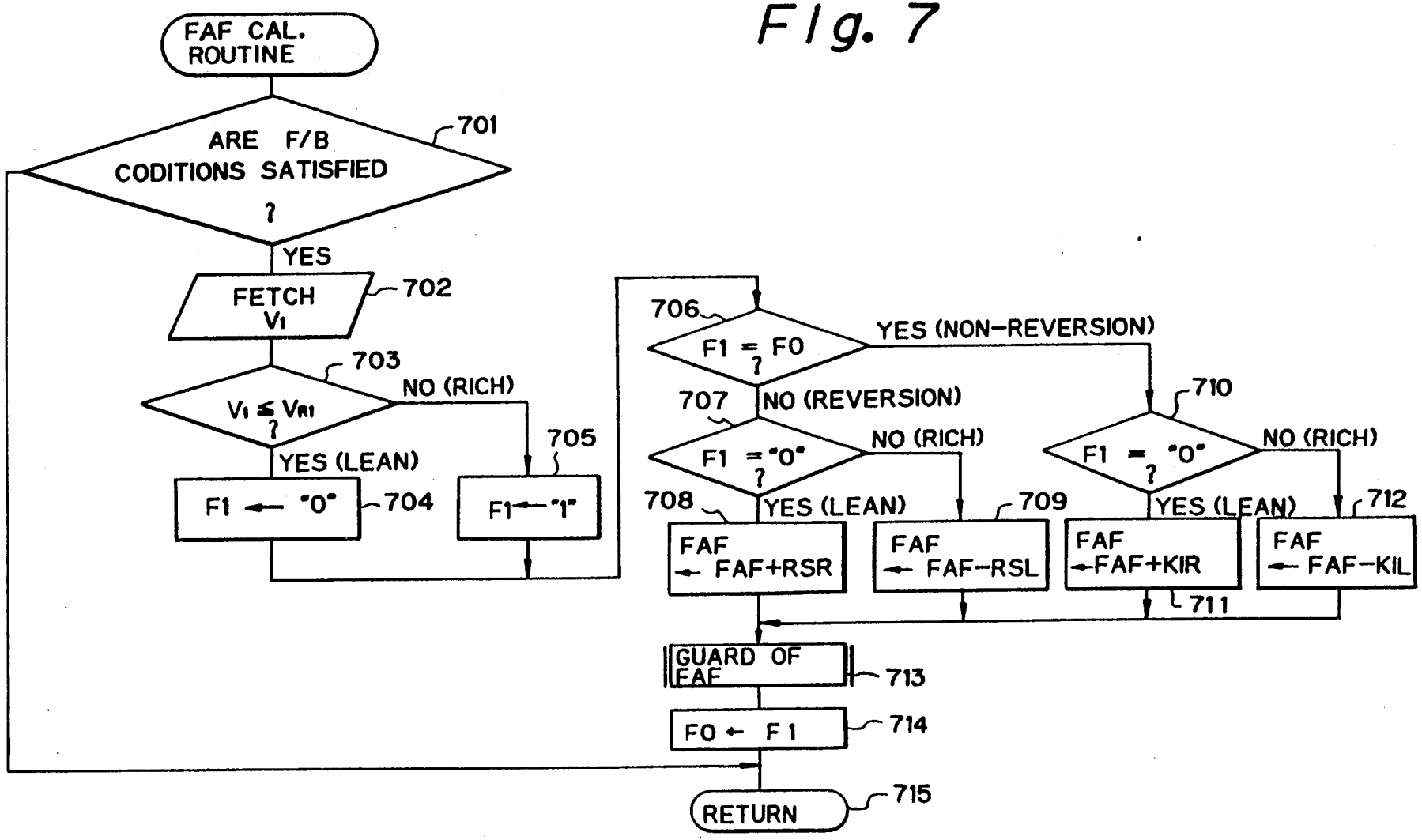
FIGS. 7, 9, 11, 12, 13, 16, 18 and 21 are flow charts showing the operation of the control circuit of FIG. 1.

FIG. 7 is a routine for calculating a air-fuel ratio feedback correction amount FAF in accordance with the output of the main $O_2$ sensor 16 executed at a predetermined interval such as 2 ms.

At step 701, it is determined whether or not all of the feedback control (closed-loop control) conditions by the main $O_2$ sensor 16 are satisfied. The feedback control conditions are as follows.

i) the engine is not in a fuel cut-off state;

ii) the engine is not in a starting state;

iii) the coolant temperature THW is higher than 50° C.;

iv) the power fuel incremental amount FPOWER is O; and v) the main $O_2$ sensor 16 is in an activated state Of course, other feedback control conditions are introduced as occasion demands, but an explanation of such other feedback control conditions is omitted.

If one or more of the feedback control conditions is not satisfied, the control proceeds to step 715, to thereby carry out an open-loop control operation. Note that, in this case, the amount FAF can be a value or a mean value immediately before the open-loop control operation. That is, the amount FAF or a mean value $\overline{FAF}$ thereof is stored in the backup RAM 106, and in an open-loop control operation, the value $\overline{RAF}$ or FAF is read out of the backup RAM 106. Note that the amount FAF can be 1.0.

Contrary to the above, at step 701, if all of the feedback control conditions are satisfied, the control proceeds to step 702.

At step 702, an A/D conversion is performed upon the output voltage $V_1$ of the main $O_2$ sensor 16, and the A/D converted value thereof is then fetched from the A/D converter 301. Then at step 703, the voltage $V_1$ is compared with the reference voltage $V_{R1}$, thereby determining whether the current air-fuel ratio detected by the main $O_2$ sensor 16 is on the rich side or on the lean side with respect to the stoichiometric air-fuel ratio.

If $V_1 \leqq V_{R1}$, which means that the current air-fuel ratio is lean, the control proceeds to step 704, which sets "0" in an air-fuel ratio flag F1. On the other hand, if $V_1 > V_{R1}$, which means that the current air-fuel ratio is rich, the control proceeds to step 705, which sets "1" in the air-fuel ratio flag F1.

Next, at step 706, it is determined whether or not the air-fuel ratio flag F1 is reversed, i.e., whether or not the air-fuel ratio detected by the main $O_2$ sensor 16 is reversed. Note that a flag F0 is a previous flag of the flag F1. If the air-fuel ratio flag F1 is reversed, the control proceeds to steps 707 to 709, which carry out a skip operation.

At step 707, if the flag F1 is "0" (lean), the control proceeds to step 708, which remarkably increases the correction amount FAF by a skip amount RSR. Also, if the flag F1 is "1" (rich) at step 707, the control proceeds to step 708, which remarkably decreases the correction amount FAF by a skip amount RSL.

On the other hand, if the air-fuel ratio flag F1 is not reversed at step 706, the control proceeds to steps 710 to 712, which carry out an integration operation. That is, if the flag F1 is "0" (lean) at step 710, the control proceeds to step 711, which gradually increases the correction amount FAF by a rich integration amount KIR. Also, if the flag F1 is "1" (rich) at step 710, the control proceeds to step 712 which gradually decreases the correction amount FAF by a lean integration amount KIL.

At step 714, the correction amount FAF is guarded by a minimum value 0.8, is guarded by a maximum value 1.2. Thus, the controlled air-fuel ratio is prevented from becoming overlean or overrich.

The correction amount FAF is then stored in the RAM 307, thus completing this routine of FIG. 7 at steps 715.

The operation by the flow chart of FIG. 7 will be further explained with reference to FIGS. 8A and 8B. As illustrated in FIG. 8A, when the air-fuel ratio A/F is obtained by the output $V_1$ of the main $O_2$ sensor 10, as illustrated in FIG. 8B, at every change of the air-fuel ratio from the rich side to the lean side, or vice versa, the correction amount FAF is skipped by the skip amount RSR or RSL, and in addition, the correction amount FAF is gradually increased or decreased in accordance with the air-fuel ratio.

A fuel injection amount TAU is calculated at every predetermined crank angle such as 360° CA. First, a base fuel injection amount $TAU_P$ is calculated by using the intake air amount data Q and the engine speed data Ne stored in the RAM 105. That is, $$TAUP \leftarrow \alpha \cdot Q/Ne$$

where $\alpha$ is a constant. Then, a final fuel injection amount TAU is calculated by $$TAU \leftarrow TAUP \cdot FAF \cdot \beta = \gamma$$

where $\beta$ and $\gamma$ are correction factors determined by other parameters such as the voltage of the battery 26 and the temperature THA of the intake air. As a result, the final fuel injection amount TAU is set in the down counter 313, and in addition, the flip-flop 314 is set to initiate the activation of the fuel injection valve 11. Then, as explained above, when a time corresponding to the amount TAU has passed, the flip-flop 314 is reset by the borrow-out signal of the down counter 313 to stop the activation of the fuel injection.

As explained above, to maintain the controlled air-fuel ratio at the predetermined air-fuel ratio, such as the stoichiometric air-fuel ratio, the element temperature of the main $O_2$ sensor 16 must be maintained at a definite temperature such as 700° C. (see FIG. 5).

A first embodiment of the present invention will be explained.

To maintain the element temperature of the main $O_2$ sensor 16 at 700° C., the resistance value of the heater 16*a* must be definite. Therefore, for this purpose, a supply power supplied to the heater 16*a* is controlled so that the resistance value of the heater 16*a* is brought close to a predetermined value.

To maintain the resistance value of the heater 16*a* at a definite value, the resistance value of the heater 16*a* must be detected, but if the resistance value of the heater 16*a* is detected, a combined resistance Rh of the resistance value of the heater 16*a* and a parasitic resistance due to lead wires and the like is actually detected. In this case, if this parasitic resistance is definite, control of the resistance value of the heater 16*a* can be replaced by control of the combined resistance Rh. Therefore, in FIG. 1, the resistor 27 is provided, and the potentials at both of the terminals of the resistor 26 are supplied to the A/D converter 301, to calculate the difference in potential between the terminals and thereby obtain a current through the heater 16*a* and the resistor 27. As a result, the combined resistance Rh can be calculated by using this obtained current.

Thus, if the engine is in a stable state, such as a long idling state, the parasitic resistance due to lead wires and the like is definite, and accordingly control of the combined resistance Rh is carried out so that the combined resistance Rh, i.e., the element temperature of the main $O_2$ sensor 16, is brought close to the definite value. For this purpose, a reference value Rt of the combined resistance value Rh is experimentally calculated in advance and is stored in the backup RAM 308.

Nevertheless, in practice, since the main $O_2$ sensor 16 is located in the exhaust system of the engine 1, for example, upstream of the catalyst converter 17, the parasitic resistance is changed in accordance with driving parameters of the engine. For example, in a high load state, the amount of exhaust gas is increased to thus increase the temperature of the lead wires as well as the temperature of the main $O_2$ sensor 16, and therefore, increase the parasitic resistance. As a result, when a control of the combined resistance Rh is carried out, the power supplied to the heater 16 is lowered to reduce the temperature of the heater 16*a*, i.e., the element temperature of the main $O_2$ sensor 16, and thus it is impossible to maintain the element temperature of the main $O_2$ sensor 16 in a high load state.

Also, in a high speed state, the amount of external air is increased to lower the temperature of the lead wires as well as the temperature of the main $O_2$ sensor 16, and thus lower the parasitic resistance. As a result, when a control of the combined resistance Rh is carried out, the power supplied to the heater 16*a* is raised to increase the temperature of the heater 16*a*, i.e., the element temperature of the main $O_2$ sensor 16, and thus it is also impossible to maintain the element temperature of the main $O_2$ sensor 16 in a high speed state.

Figure 9A:
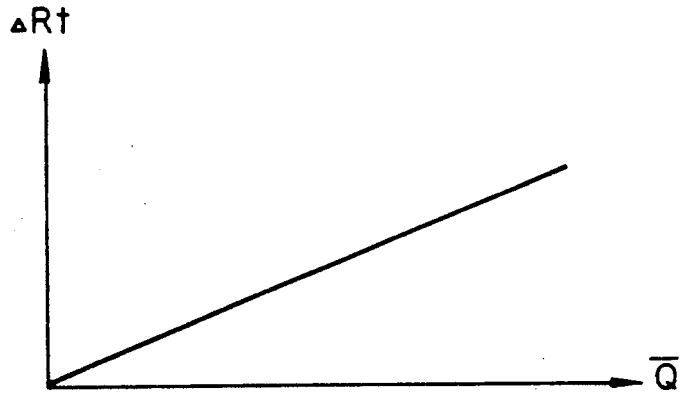

Thus, when the intake air amount Q is increased to increase the exhaust gas, the parasitic resistance is also increased. Therefore, in this case, when the reference value Rt is increased by an amount corresponding to the increased parasitic resistance, the temperature of the heater 16*a*, i.e., the element temperature of the main $O_2$ sensor 16, can be maintained at the definite value. Therefore, an increase $\Delta Rt$ of the increased parasitic resistance is experimentally obtained. Also, there is a time delay between the increase (decrease) of the intake air amount Q and the increase (decrease) of the parasitic resistance. Therefore, according to the present invention, as illustrated in FIG. 9A, the increase ΔRt of the reference resistance value Rt is determined in accordance with the mean or blunt value $\overline{Q}$ of the intake air amount Q.

Figure 9B:
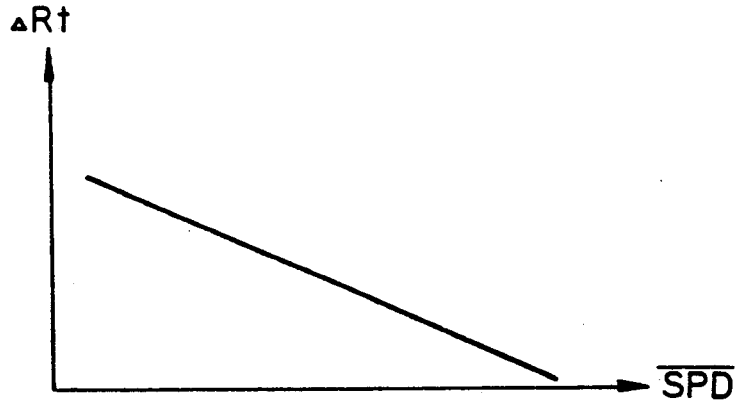

Also, when the vehicle speed SPD is increased, the parasitic resistance is decreased. Therefore, in this case, then the reference value Rt is decreased by an amount corresponding to the decreased parasitic resistance, the temperature of the heater 16a, i.e., the element temperature of the main $O_2$ sensor 16, can be maintained at the definite value. Therefore, a decrease ΔRt of the decreased parasitic resistance is experimentally obtained. Also, there is a time delay between the decrease (increase) of the vehicle speed SPD and the decrease (increase) of the parasitic resistance. Therefore, according to the present invention, as illustrated in FIG. 9B, the decrease ΔRt of the reference resistance value Rt is determined in accordance with the mean or blunt value $\overline{SPD}$ of the vehicle speed SPD.

Thus, according to the present invention, a correction amount (increase or decrease amount) of the reference value Rt of the heater 16a is dependent upon two driving parameters $\overline{Q}$ and $\overline{SPD}$. That is, the following two-dimensional map depending on the parameters $\overline{Q}$ and $\overline{SPD}$ is stored in the ROM 306.

TABLE I

| | $\overline{Q}_1$ | $\overline{Q}_2$ | | $\overline{Q}_m$ |
|---|---|---|---|---|
| $\overline{SPD}_1$ | $\Delta Rt_{11}$ | $\Delta Rt_{12}$ | ... | $\Delta Rt_{1m}$ |
| $\overline{SPD}_2$ | $\Delta Rt_{21}$ | $\Delta Rt_{22}$ | ... | |
| | . | . | | . |
| | . | . | | . |
| | . | . | | . |
| $\overline{SPD}_n$ | $\Delta Rt_{n1}$ | | ... | $\Delta Rt_{nm}$ |

Figure 10:
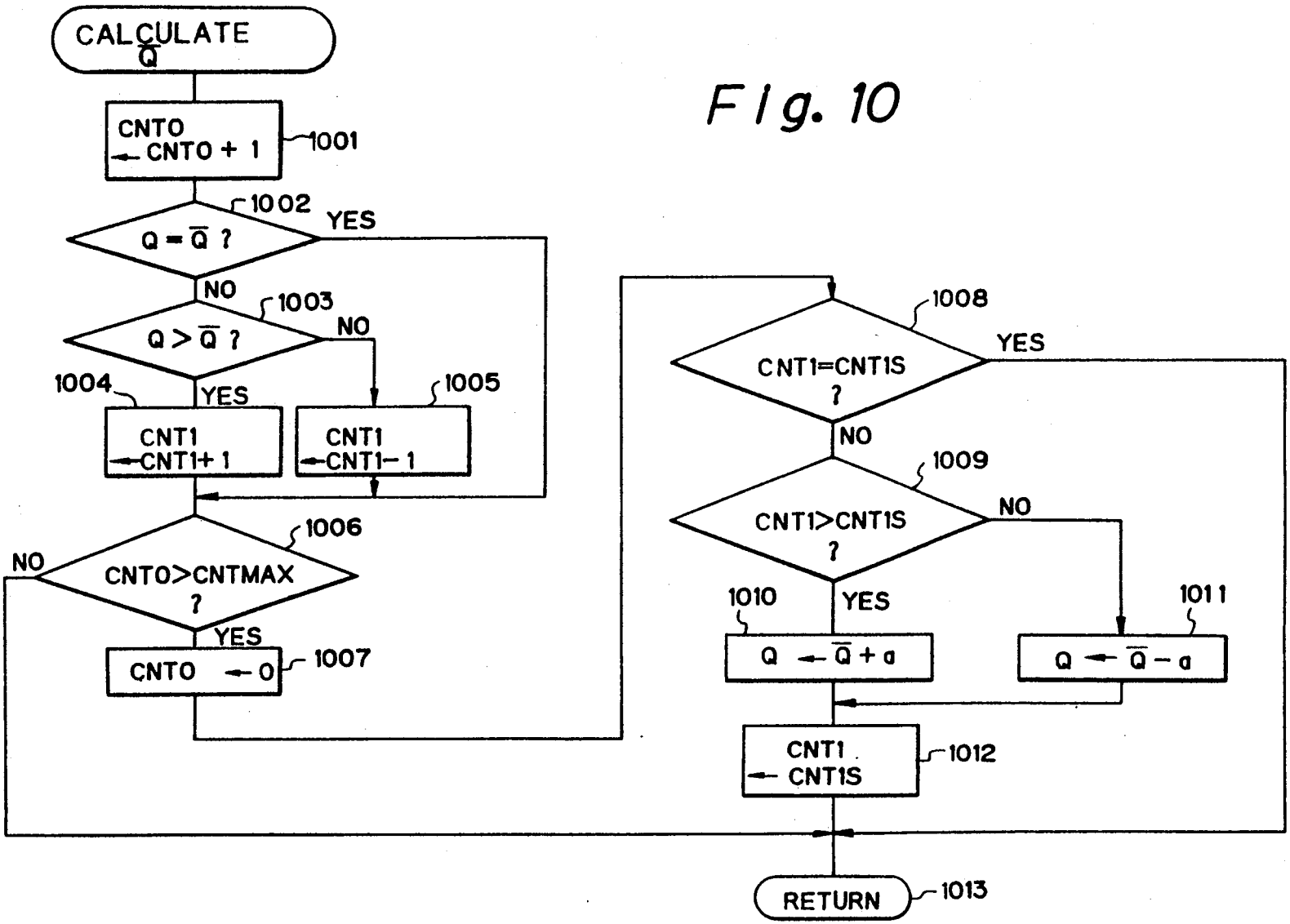
FIGS. 10A and 10B are diagrams explaining the flow chart of FIG. 9.

FIG. 10 is a routine for calculating a blunt value $\overline{Q}$ of the intake air amount Q executed at predetermined intervals of, for example, 4 ms. At step 1001, a counter value CNT0 is counted up by +1. Then, at step 1002, the intake air amount Q is read out of the RAM 307, and it is determined whether or not Q is equal to the current blunt value $\overline{Q}$, and at step 1003, it is determined whether or not $Q>\overline{Q}$ is satisfied. As a result, when $Q>\overline{Q}$, the control proceeds to step 1004 which counts up a counter value CNT1 by +1, and when $Q>\overline{Q}$, the control proceeds to step 1005 which counts down the counter value CNT1 by 1. Also, when $Q=\overline{Q}$, the control proceeds directly to step 1006.

At step 1006, it is determined whether or not the counter value CNT0 has reaches a maximum value CNTMAX, i.e., a timing at which the blunt value $\overline{Q}$ is renewed, has been reached. Only when a renewing timing has been reached does the control proceed to step 1007, which cleans the counter value CNT0, and thereafter, proceeds to steps 1008 through 1012.

At step 1008, it is determined whether or not the counter value CNT1 is equal to a predetermined value CNT1S, and at step 1009, it is determined whether or not CNT1>CNT1S is satisfied. As a result, when CNT1>CNT1S, the control proceeds to step 1010 which increases the blunt value $\overline{Q}$ by a, and when CNT1<CNT1S, the control proceeds to step 1011 which decreases the blunt value $\overline{Q}$ by a. Then at step 1012, the counter value CNT1 is initialized at CNT1S. Also, when CNT1=CNT1S, the control proceeds directly to step 1013.

Then, this routine is completed by step 1013.

Note that the blunt value $\overline{Q}$ can be calculated by $$\overline{Q} \leftarrow \frac{\overline{Q} + (n-1)Q}{n}$$

where n=4, 16, 32, . . . .

Also, the blunt value $\overline{Q}$ can be replaced by a mean value $\overline{Q}$ as follows.

$$\overline{Q} \leftarrow \frac{Q_0 + Q_1 + \cdots + Q_{n-1}}{n}$$

where n=2, 3, 4, . . . .

A change of any blunt or mean value $\overline{Q}$ of the intake air amount Q follows a change of the intake air amount Q, after a delay.

Figure 11:
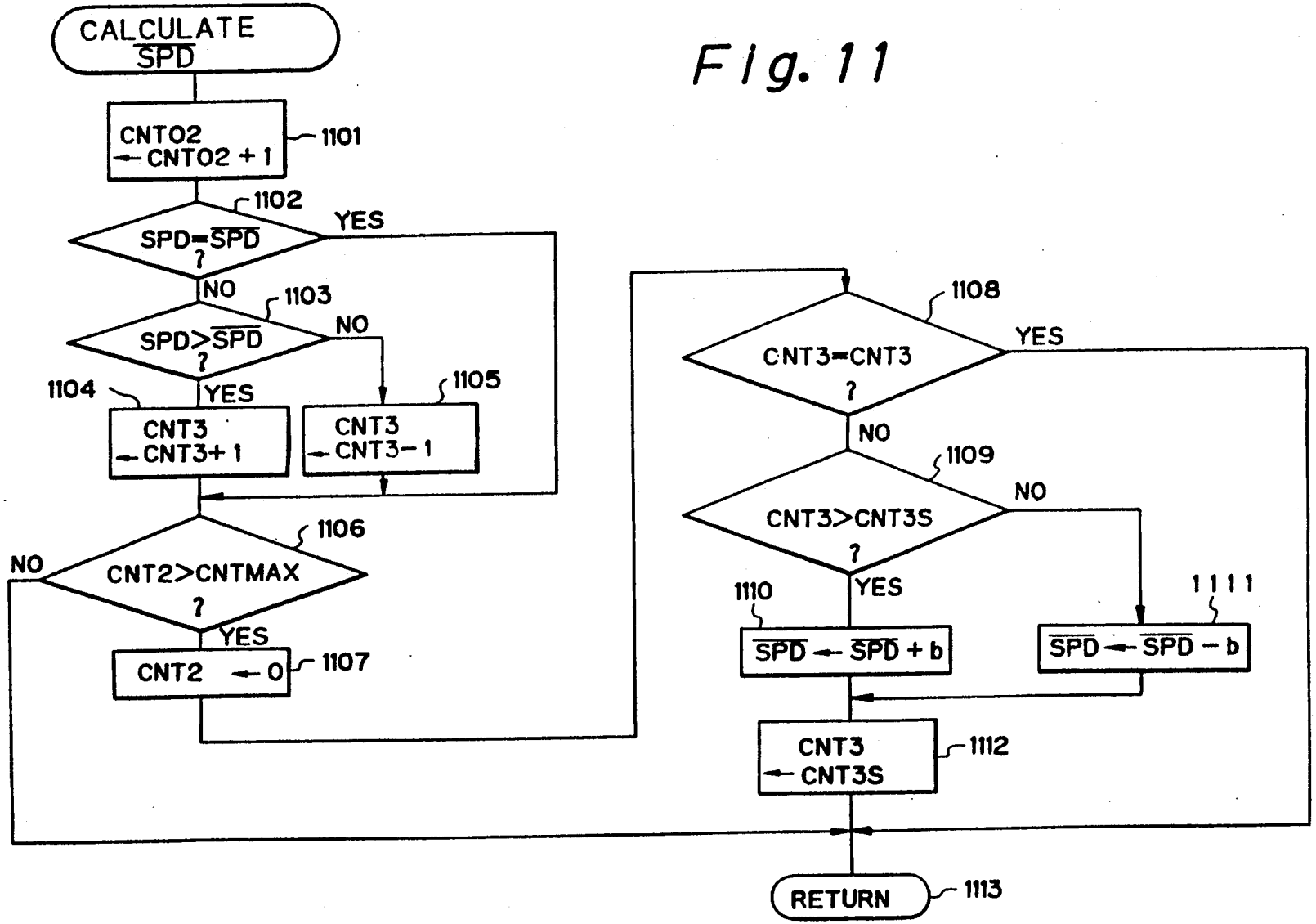

FIG. 11 is a routine for calculating a blunt value $\overline{SPD}$ of the vehicle speed SPD executed at a predetermined internal of, for example, 4 ms. At step 1101, a counter value CNT2 is counted up by +1. Then, at step 1202, the vehicle speed SPD is fetched from the vehicle speed generating circuit 308, and it is determined whether or not SPD is equal to the current blunt $\overline{SPD}$, and at step 1103, it is determined whether or not $SPD>\overline{SPD}$ is satisfied. As a result, when $SPD>\overline{SPD}$, the control proceeds to step 1104 which counts up a counter value CNT3 by +1, and when $SPD<\overline{SPD}$, the control proceeds to step 1105 which counts down the counter value CNT3 by 1. Also, when $SPD=\overline{SPD}$, the control proceeds directly to step 1106.

At step 1106, it is determined whether or not the counter value CNT2 reaches the maximum value CNTMAX, i.e., a timing at which the blunt $\overline{SPD}$ is renewed has been reached. Only when a renewing timing has been reached does the control proceed to step 1107 which clears the counter value CNT2, and thereafter, proceeds to steps 1108 through 1112.

At step 1108, it is determined whether or not the counter value CNT3 is equal to a predetermined value CNT3T, and at step 1109, it is determined whether or not CNT3>CNT36 is satisfied. As a result, when CNT3>CNT3S, the control proceeds to step 1110 which increases the blunt value $\overline{SPD}$ by b, and when CNT3<CNT3S, the control proceeds to step 1111 which decreases the blunt value $\overline{SPD}$ by b. Then at step 1112, the counter value CNT3 is initialized at CNT3S. Also, when CNT3=CNT3S, the control proceeds directly to step 1113.

Then, this routine is completed by step 1113.

Note that the blunt value $\overline{SPD}$ can be also calculated by $$\overline{SPD} \leftarrow \frac{SPD + (n-1)SPD}{n}$$

where n=1, 16, 32, . . . .

Also, the blunt value $\overline{SPD}$ can be replaced by a mean value $\overline{SPD}$ as follows.

$$\overline{SPD} \leftarrow \frac{SPD_0 + SPD_1 + \cdots + SPD_{n-1}}{n}$$

where n=2, 3, 4, . . . .

A change of any blunt or mean value $\overline{SPD}$ of the vehicle speed SPD follows a change of the vehicle speed SPD after a delay.

Figure 12:
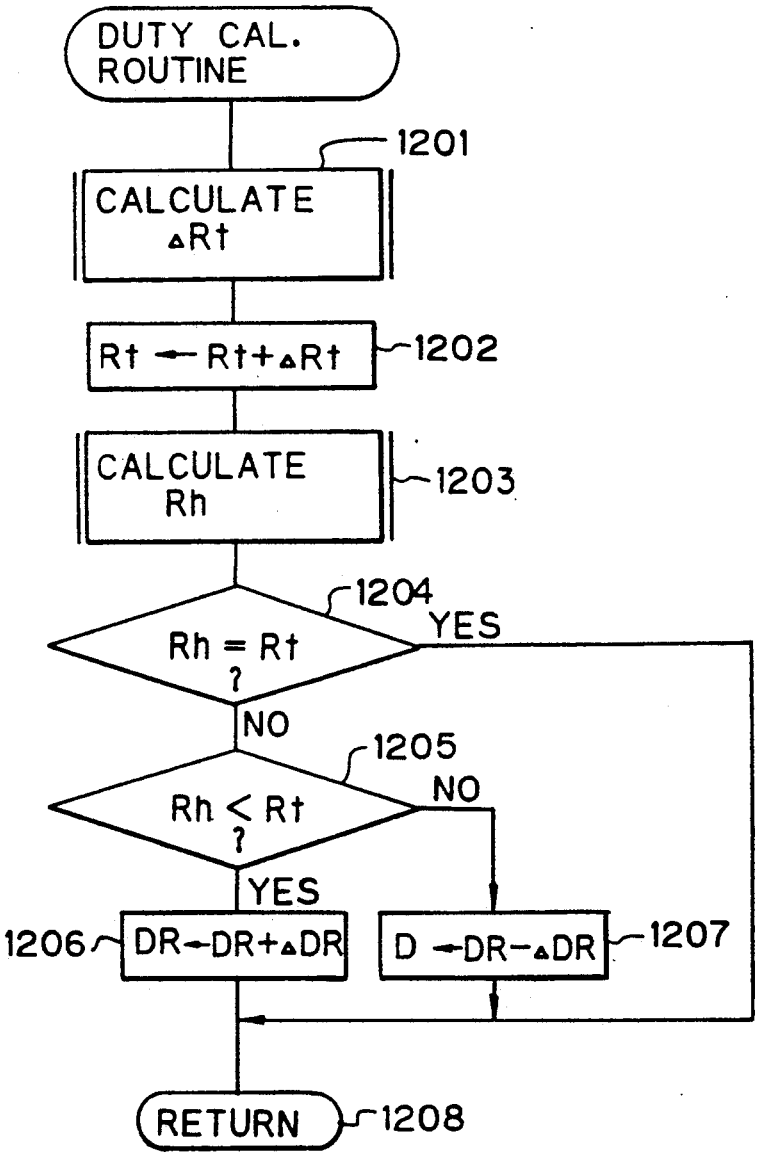

FIG. 12 is a routine for calculating a duty ratio DR of the power supplied to the heater 16a, and is executed at a predetermined interval of, for example, 16 ms. At step 1201, a correction amount ΔRt for the reference value Rt is calculated from the two-dimensional map TABLE I stored in the ROM 306 using the parameters $\overline{Q}$ and $\overline{SPD}$ stored in the RAM 307. Then at step 1202, the reference value Rt is read out of the backup RAM 308, and is corrected by $$Rt \leftarrow Rt + \Delta Rt.$$

At step 1203, a combined resistance Rh is calculated. That is, an A/D conversion is performed upon the voltage $V_B$ of the battery 27, and further, an A/D conversion is performed upon the potential $V_0$ at the connection of the heater 16a and the resistor 27. Next, a current I flowing through the resistor 27, i.e., the heater 16a is calculated by $$I \leftarrow (V_B - V_0)/R$$

where R is the resistance value of the resistor 27. Then, the combined resistance Rh is calculated by $$Rh \leftarrow V_0/I.$$

At step 1204, it is determined whether or not Rh is equal to the corrected reference value $V_{Rt}$, and at step 1205, it is determined whether or not Rh<Rt is satisfied. As a result, when Rh<Rt, the control proceeds to step 1206 which increases the duty ratio DR by a definite value ΔDR, and when Rh>Rt, the control proceeds to step 1207 which decreases the duty ratio DR by the definite value ΔDR. Also, when Rh=Rt, the control proceeds directly to step 1208.

The routine of FIG. 12 is completed by step 1208.

Figure 13:
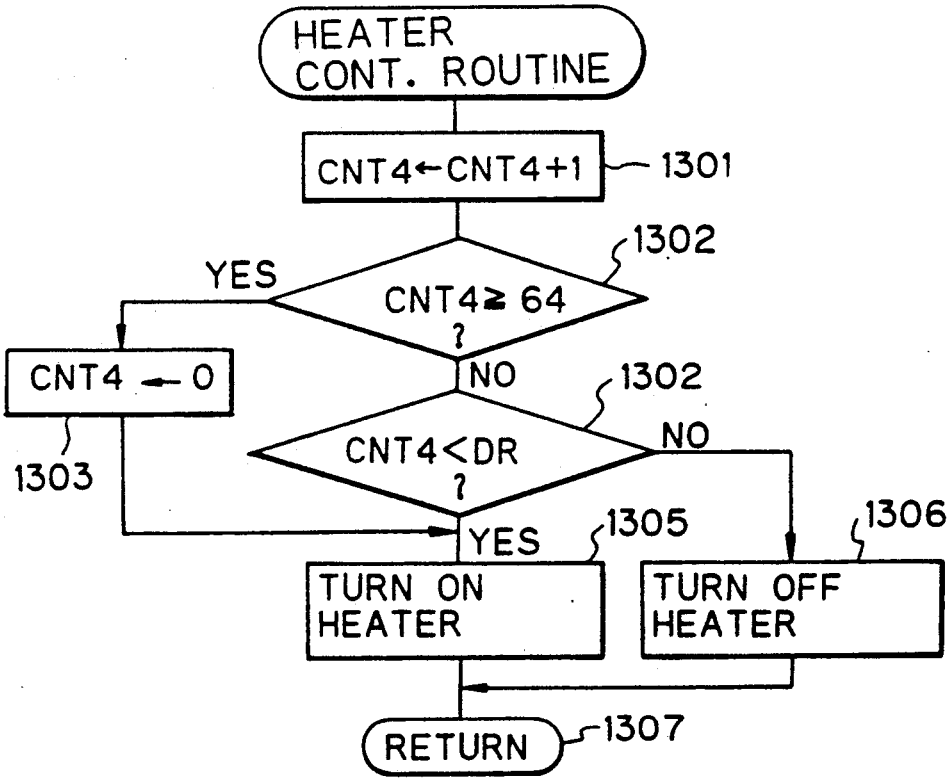
Figure 14:
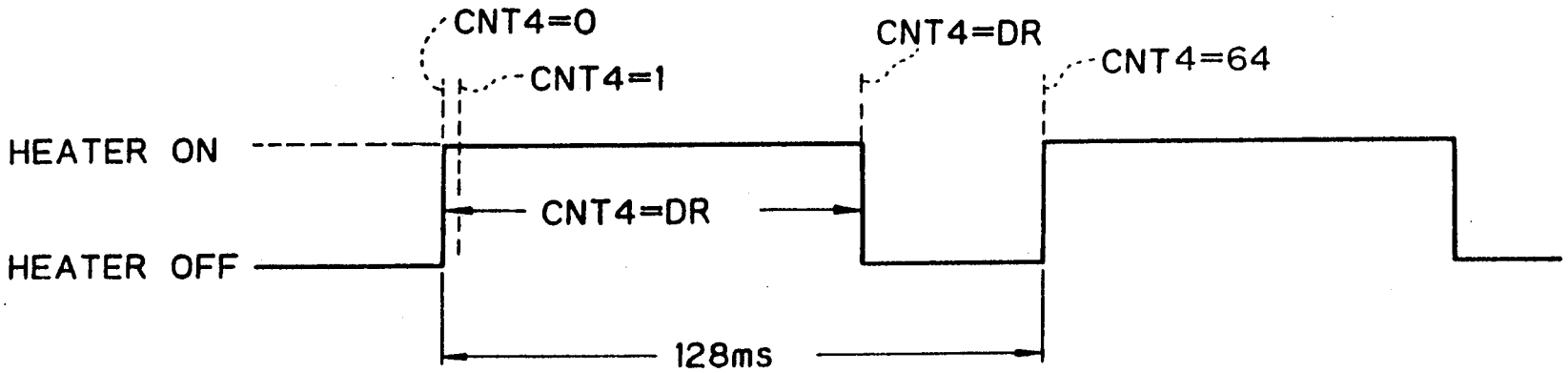
FIG. 14 is a timing diagram explaining the flow chart of FIG. 13.

FIG. 13 is a routine for controlling the ON-duty ratio of the heater 16a in accordance with the duty ratio DR calculated by the routine of FIG. 12, and executed at a predetermined interval such as 2 ms. At step 1301, a counter value CNT4 is counted up by 1, and at step 1302, it is determined whether or not the counter value CNT4 has reached a predetermined value such as 64(=128 ms/2 ms). As a result, when CNT4≧64, the control proceeds to step 1303 at which the counter CNT4 is cleared. Then, at step 1305, the heater 16a is turned ON. Namely, as illustrated in FIG. 14, the counter CNT4 is repeated for a predetermined time such as 128 ms. Conversely, when CNT<128, the control proceeds to step 1304, at which it is determined whether or not the counter value CNT4 has reached the duty ratio DR. As a result, when CNT4>DR, the control proceeds to step 1305 at which the heater 16a is turned ON, and when CNT4≧DR, the control proceeds to step 1306 and the heater 16a is turned OFF. Then, the routine of FIG. 13 is completed by step 1307.

Thus, the heater 16a is turned ON for a period (CNT4=DR) per every period of 128 ms as illustrated by FIG. 14, and therefore, the temperature of the heater 16a can be adjusted by the duty ratio DR. As a result, the combined resistance Rh is brought close to the reference value Rt corrected by the parameters $\overline{Q}$ and $\overline{SPD}$, and accordingly, the temperature of the heater 16a, i.e., the element temperature of the main $O_2$ sensor 16, can be maintained at the definite value such as 700° C.

Nevertheless, even if the reference value Rt is corrected by the correction amount ΔRt determined by the parameters $\overline{Q}$ and $\overline{SPD}$, the corrected reference value Rt does not always coincide with the constant temperature (700° C.) of the main $O_2$ sensor 16, because, the correction amount ΔRt is not completely compensated by the characteristics as shown in FIGS. 9A and 9B. Also, if the resistance value Rm of the main $O_2$ sensor 16 per se is changed due to the elapse of a long time, it is impossible to maintain the element temperature of the main $O_2$ sensor 16 at the definite value such as 700° C. even when the combined resistance Rh is made equal to the reference value Rt. As a result, a deviation of the controlled air-fuel ratio from the predetermined air-fuel ratio such as the stoichiometric air-fuel ratio occurs.

To compensate the above-mentioned deviation of the controlled air-fuel ratio, according to the present invention, the sub $O_2$ sensor 19 is provided downstream of the catalyst converter 17. Since the sub $O_2$ sensor 19 is a zirconia type, the sub $O_2$ sensor 19 has Z-output characteristics as shown in FIG. 15. That is, the output $V_2$ of the sub $O_2$ sensor 19 is changed rapidly at the stoichiometric air-fuel ratio (λ=1). Also, although the zirconia type sub $O_2$ sensor 19 has an inferior response compared with that of the titania type sub $O_2$ sensor 16, the zirconia type sub $O_2$ sensor is not affected by the temperature thereof under the condition that this temperature is higher than a predetermined value. Thus, when the element temperature of the sub $O_2$ sensor 19 is higher than the predetermined value, the sub $O_2$ sensor 19 always has the output characteristics as shown in FIG. 15. Accordingly, if a reference voltage $V_{R2}$ is set as shown in FIG. 15, the controlled air-fuel ratio downstream of the catalyst converter 17 can be clearly determined by the sub $O_2$ sensor 19.

Figure 16:
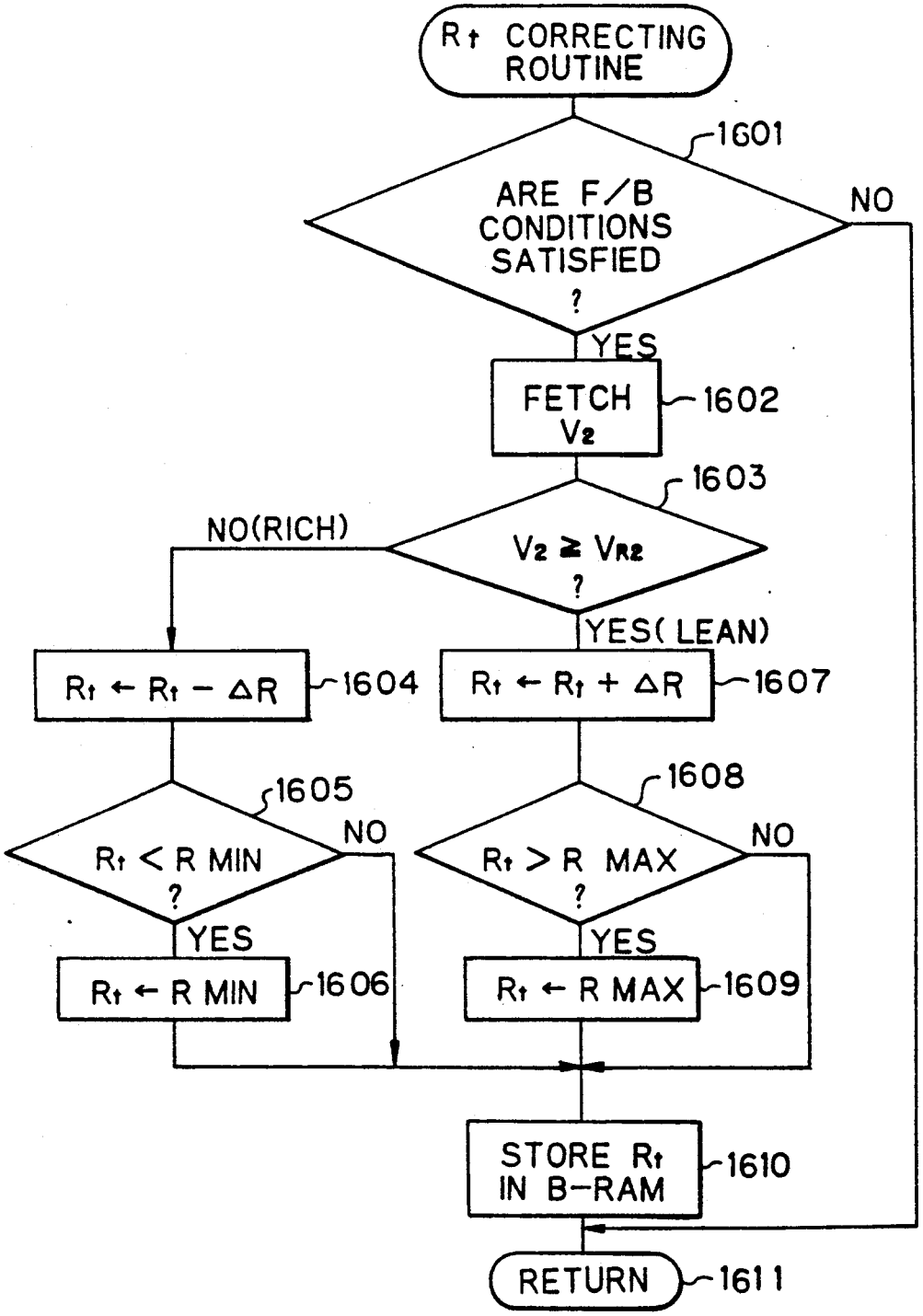

FIG. 16 is a routine for correcting the reference value Rt in accordance with the output $V_2$ of the sub $O_2$ sensor 19 executed at a predetermined interval such as 1024 ms.

At step 1601, it is determined whether or not all of the feedback control (closed-loop control) conditions by the sub $O_2$ sensor 19 are satisfied. For example, it is determined whether or not the feedback control conditions (step 701 of FIG. 7) by the main $O_2$ sensor 16 are satisfied. Also, it is determined whether or not the coolant temperature THW is higher than 70° C.; whether or not the change of the throttle valve 14 is small; whether or not a load parameter such as $Q/N_e$, ΔQ is smaller than a predetermined value; and whether or not the sub $O_2$ sensor 19 is active. Of course, other feedback control conditions are introduced as occasion demands.

If one or more of the feedback control conditions is not satisfied, the control directly proceeds to step 1611, thereby carrying out an open-loop control operation. Contrary to the above, if all of the feedback control conditions are satisfied, the control proceeds to step 1602.

At step 1602, an A/D conversion is performed upon the output $V_2$ of the sub $O_2$ sensor 19 and the A/D converted value thereof is fetched from the A/D converter 101. At step 1603, the voltage $V_2$ is compared with the reference voltage $V_{R2}$, thereby determining whether the current air-fuel ratio detected by the sub $O_2$ sensor 19 is on the rich side or on the lean side with respect to the stoichiometric air-fuel ratio.

At step 1603, if the air-fuel ratio downstream of the catalyst converter 17 is rich, the control proceeds to step 1604 which decreases the reference value Rt by a definite value ΔR. Then, at steps 1605 and 1606, the reference value Rt is guarded by a minimum value RMIN, thus preventing the controlled air-fuel ratio from becoming overlean.

At step 1603, if the air-fuel ratio downstream of the catalyst converter 17 is lean, the control proceeds to step 1607 which increases the reference value Rt by the definite value ΔR. Then, at steps 1608 and 1609, the reference value Rt is guarded by a maximum value RMAX, thus preventing the controlled air-fuel ratio from becoming overrich.

Then, at step 1610, the corrected reference value Rt is stored in the backup RAM 308.

The routine of FIG. 16 is completed by step 1611.

According to the routine of FIG. 16, as illustrated in FIGS. 17A, 17B, and 17C, when the air-fuel ratio downstream of the catalyst converter 17 is lean ($V_2 \geqq V_{R2}$), the reference value Rt is reduced, to lower the element temperature of the main $O_2$ sensor 16. As a result, the resistance value $R_m$ of the main $O_2$ sensor 16 is increased to make the controlled air fuel ratio rich, and finally, the controlled air-fuel ratio becomes the stoichiometric air-fuel ratio.

Contrary to the above, when the air-fuel ratio downstream of the catalyst converter 17 is rich ($V_2 < V_{R2}$), the reference value Rt is increased to increase the element temperature of the main $O_2$ sensor 16. As a result, the resistance value $R_m$ of the main $O_2$ sensor 16 is decreased to make the controlled air-fuel ratio lean, and finally, the controlled air-fuel ratio becomes the stoichiometric air-fuel ratio.

Thus, the controlled air-fuel ratio can be accurately set at the stoichiometric air-fuel ratio by changing the reference value Rt in accordance with the output $V_2$ of the sub $O_2$ sensor 19.

A second embodiment of the present invention will be explained.

In this second embodiment, the power supplied to the heater 16a is brought close to an aimed power supply determined by driving states of the engine, to maintain the element temperature of the main $O_2$ sensor 16 at a definite value such as 700° C. That is, when the temperature THA of the intake air is at a predetermined value THA0, an aimed power supply $P_{ij}$ for the engine load $Q/N_e$ and the engine speed $N_e$ are experimentally obtained. That is, the following two-dimensional map depending on the parameters $Q/N_e$ and $N_e$ is stored in backup RAM 308.

TABLE II

| | $N_1$ | $N_2$ | | $N_m$ |
|---|---|---|---|---|
| $(Q/N)_1$ | $\Delta P_{11}$ | $\Delta P_{12}$ | ... | $\Delta P_{1m}$ |
| $(Q/N)_2$ | $\Delta P_{21}$ | $\Delta P_{22}$ | ... | |
| . | . | . | | . |
| . | . | . | | . |
| . | . | . | | . |
| $(Q/N)_n$ | $\Delta P_{n1}$ | | ... | $\Delta P_{nm}$ |

In a high load state, a fuel injection amount is increased to increase the temperature of the exhaust gas, thereby increasing the element temperature of the main $O_2$ sensor 16. Therefore, in Table II, the larger the engine load $Q/N_e$, the smaller the aimed power supply $P_{ij}$. On the other hand, in a high speed state, the rate of the exhaust gas is increased to also increase the element temperature of the main $O_2$ sensor 16. Therefore, in Table II, the larger the engine speed $N_e$, the smaller the aimed power supply $P_{ij}$.

Figure 18:
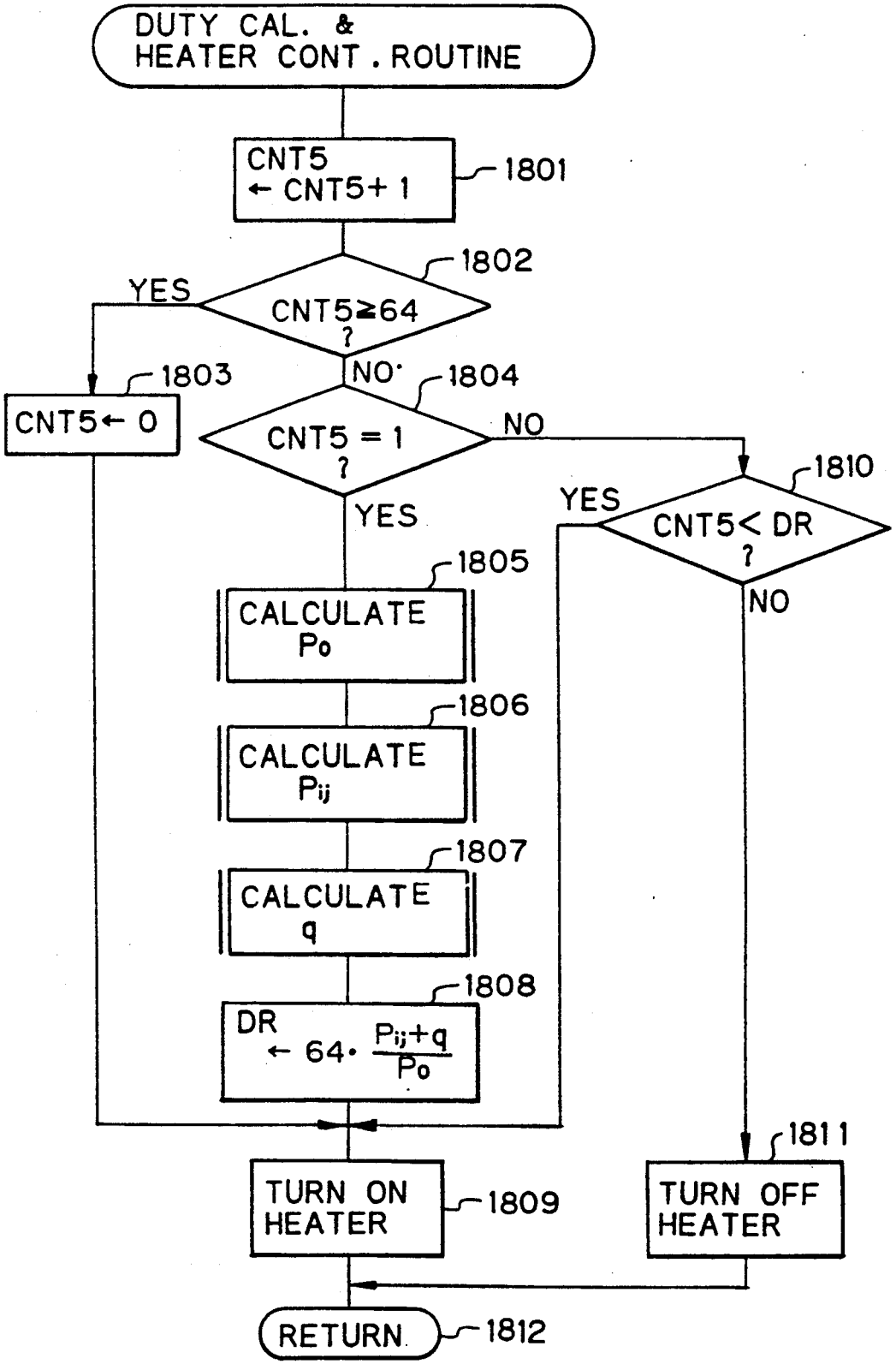

FIG. 18 is a routine for calculating a duty ratio DR of the power supplied to the heater 16a and controlling the heater 16a, and is executed at a predetermined interval such as 2 ms. At step 1801, a counter value CNT5 is counted up by +1. Then, at step 1802, it is determined whether or not the counter value CNT5 has reached 64 (=128 ms/2 ms); at step 1803, it is determined whether or not the counter value CNT5 has reached 1 (=2 ms); and at step 1804, it is determined whether or not the counter value CNT5 has reached the duty ratio DR.

Figure 20:
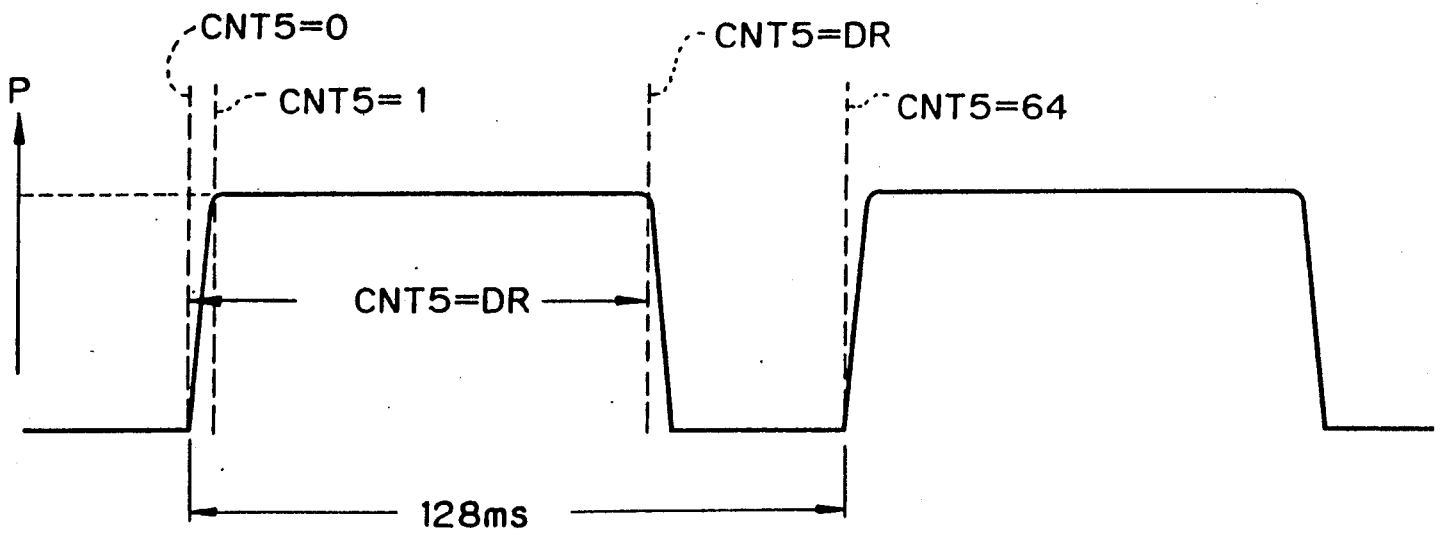
FIG. 20 is a timing diagram explaining the flow chart of FIG. 19.

As a result, when CNT5≧64, the control proceeds to step 1805, at which the counter CNT5 is cleared. Then, at step 1810, the heater 16a is turned ON. Namely, as illustrated in FIG. 20, the counter CNT5 is operation repeated for a predetermined time such as 128 ms.

When CNT5 is 1, the control proceeds to steps 1806 through 1809. At step 1806, a current power supply $P_o$ to the heater 16a is calculated. That is, an A/D conversion is performed upon the voltage $V_B$ of the battery 27, and further, an A/D conversion is performed upon the potential $V_o$ at the connection of the heater 16a and the resistor 27. Next, a current I flowing through the resistor 27, i.e., the heater 16a, is calculated by $$I \leftarrow (V_B - V_o)/R$$

where R is the resistance value of the resistor 27. Then, the power supply $P_o$ per one period (128 ms) is calculated by $$P_o \leftarrow V_o^2/I \times 0.128$$

Figure 19:
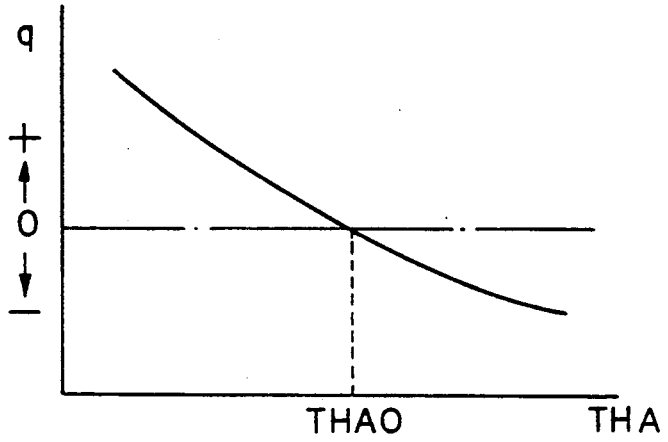
FIG. 19 is a graph explaining the flow chart of FIG. 18.

At step 1807, an aimed power supply $P_{ij}$ per one period of 128 ms is calculated from the two-dimensional map of TABLE II stored in the backup RAM 307, using the parameters $Q/N_e$ and $N_e$ stored in the RAM 307. Then at step 1808, a correction amount q is calculated from the one-dimensional map of FIG. 19 stored in the ROM 306, using the temperature THA of the intake air stored in the RAM 307. Then, at step 1809, a duty ratio DR is calculated by $$DR \leftarrow 64 \cdot \frac{P_{ij} + q}{P_o}$$

Then, the control proceeds to step 1810, which turns ON the heater 16a.

On the other hand, when 1<CNT5<DR, the control proceeds to step 1810, which also turns ON the heater 16a. Conversely, when DR≦CNT5<64, the control proceeds to step 1811, which turns OFF the heater 16a.

The routine of FIG. 18 is completed by step 1812.

Thus, the power supply P to the heater 16a is obtained as shown in FIG. 20.

Figure 21:
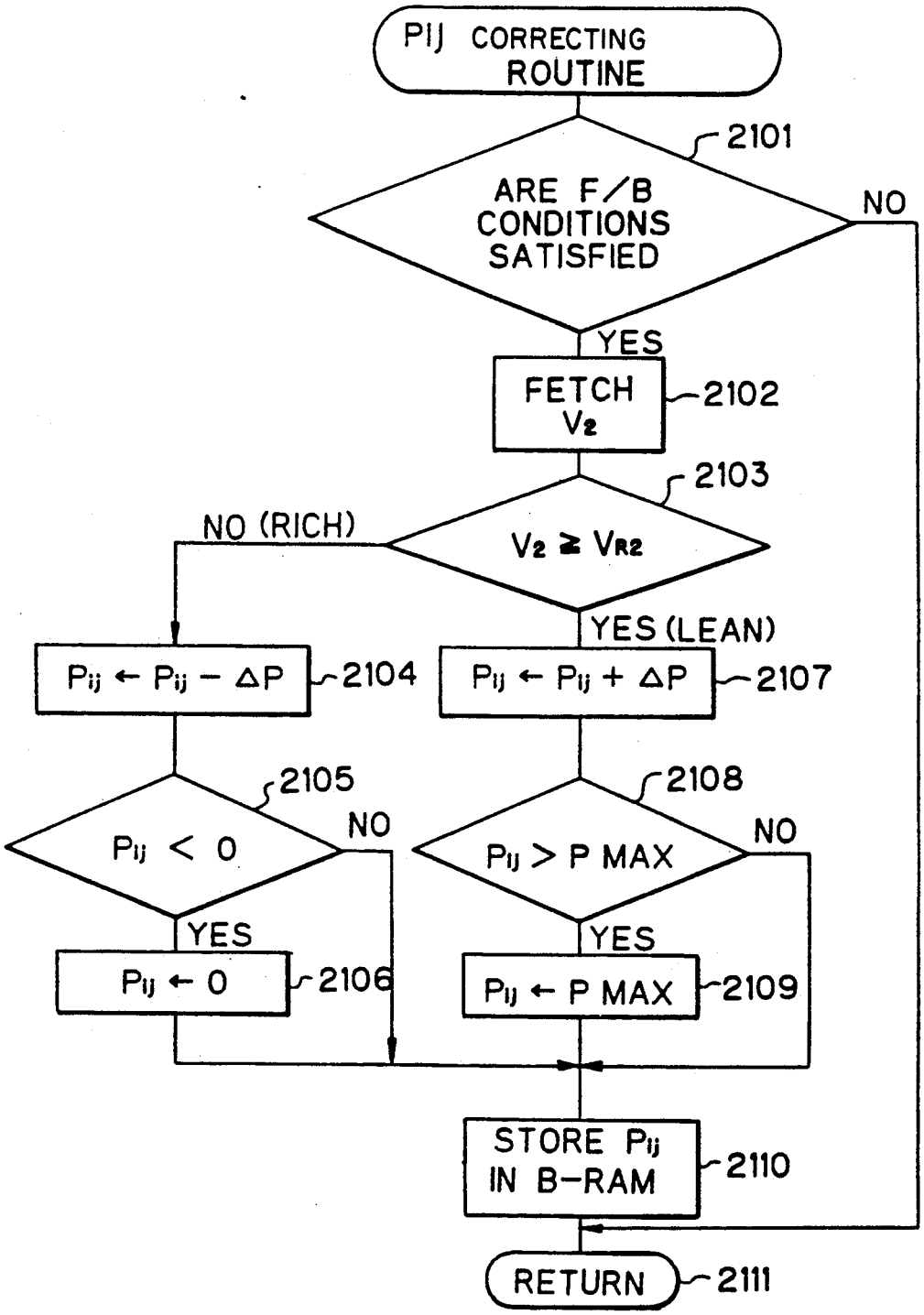

FIG. 21 is a routine for correcting the aimed power supply $P_{ij}$ in accordance with the output $V_2$ of the sub $O_2$ sensor 19 executed at a predetermined internal such as 1024 ms.

At step 2101, it is determined whether or not all of the feedback control (closed-loop control) conditions by the sub $O_2$ sensor 19 are satisfied. For example, it is determined whether or not the feedback control conditions (step 701 of FIG. 7) by the main $O_2$ sensor 16 are satisfied. Also, it is determined whether or not the coolant temperature THW is higher than 70° C.; whether or not the change of the throttle valve 14 is small; whether or not a load parameter such as $Q/N_e$, ΔQ is smaller than a predetermined value; and whether or not the sub $O_2$ sensor 19 is active. Of course, other feedback control conditions are introduced as occasion demands.

If one or more of the feedback control conditions is not satisfied, the control directly proceeds to step 2111, thereby carrying out an open-loop control operation. Contrary to the above, if all of the feedback control conditions are satisfied, the control proceeds to step 2102.

At step 2102, an A/D conversion is performed upon the output $V_2$ of the sub $O_2$ sensor 19 and the A/D converted value thereof is fetched from the A/D converter 101. At step 2103, the voltage $V_2$ is compared with the reference voltage $V_{R2}$, thereby determining whether the current air-fuel ratio detected by the sub $O_2$ sensor 19 is on the rich side or on the lean side with respect to the stoichiometric air-fuel ratio.

At step 2103, if the air-fuel ratio downstream of the catalyst converter 17 is rich, the control proceeds to step 2104. At step 2104, a power supply data $F_{ij}$ is read out of a region of the backup RAM 307 for the current engine load $Q/N_e$ and the current engine speed $N_e$. Then, the data $P_{ij}$ is decreased by a definite value $\Delta P$, and at steps 2105 and 2106, the data $P_{ij}$ is guarded by a minimum value O.

At step 2103, if the air-fuel ratio downstream of the catalyst converter 17 is lean, the control proceeds to step 2107. At step 2107, a power supply data $P_{ij}$ is read out of a region of the backup RAM 307 for the current engine load $Q/N_e$ and the current engine speed $N_e$. Then, the data $P_{ij}$ is increased by the definite value $\Delta P$, and at steps 2108 and 2109, the data $P_{ij}$ is guarded by a maximum value PMAX, thus preventing the controlled air-fuel ratio from becoming over rich.

Then, at step 2110, the corrected data $P_{ij}$ is stored in the backup RAM 308.

The routine of FIG. 21 is completed by step 2112.

Figure 22A:
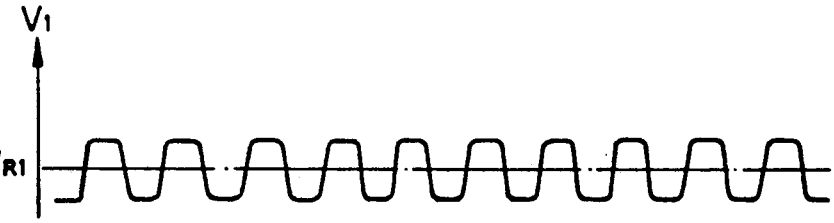
FIGS. 22A, 22B, and 22C are timing diagrams explaining the flow chart of FIG. 21.
Figure 22B:
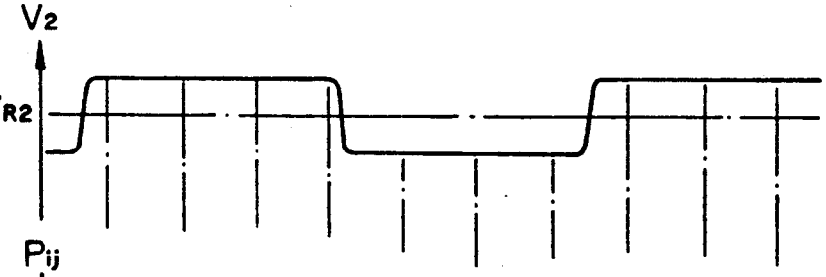
Figure 22C:
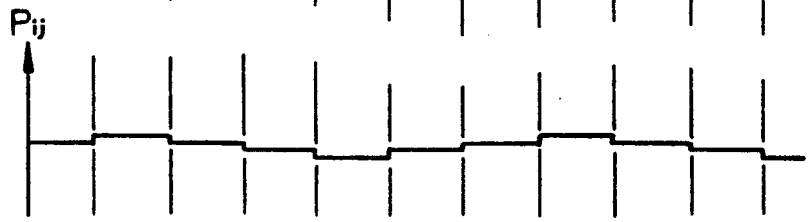

According to the routine of FIG. 21, as illustrated in FIGS. 22A, 22B, and 22C, when the air-fuel ratio downstream of the catalyst converter 17 is lean ($V_2 \geqq V_{R2}$), the power supply $P_{ij}$ is reduced, to reduce the element temperature of the main $O_2$ sensor 16. As a result, the resistance value $R_m$ of the main $O_2$ sensor 16 is increased to make the controlled air-fuel ratio rich, and finally, the controlled air-fuel ratio becomes the stoichiometric air-fuel ratio.

Contrary to the above, when the air-fuel ratio downstream of the catalyst converter 17 is rich ($V_2 < V_{R2}$), the power supply $P_{ij}$ is increased, to increase the element temperature of the main $O_2$ sensor 16. As a result, the resistance value $R_m$ of the main $O_2$ sensor 16 is decreased to make the controlled air-fuel ratio lean, and finally, the controlled air-fuel ratio becomes the stoichiometric air-fuel ratio.

Thus, the controlled air-fuel ratio can be accurately set at the stoichiometric air-fuel ratio by changing the power supply $P_{ij}$ in accordance with the output $V_2$ of the sub $O_2$ sensor 19.

Note that the main $O_2$ sensor 16 can be located downstream of the catalyst converter 17.

As explained above, according to the present invention, even when the main air-fuel ratio sensor is strongly affected by the temperature thereof, the controlled air-fuel ratio can be accurately set at a predetermined air-fuel ratio such as the stoichiometric air-fuel ratio.

We claim:

1. An apparatus for controlling an air-fuel ratio in an internal combustion engine, comprising:

a main air-fuel ratio sensor, disposed in an exhaust system of the engine, for detecting a specific component of the exhaust gas thereof;

an electric heater, associated with said main air-fuel ratio sensor, for heating said main air-fuel ratio sensor;

a catalyst converter, disposed in the exhaust system of the engine, for removing pollutants from the exhaust gas thereof;

a sub air-fuel ratio sensor, disposed downstream of said catalyst converter, for detecting a specific component in the exhaust gas of the engine;

means for controlling an actual air-fuel ratio in accordance with the output of said main air-fuel ratio sensor so that said actual air-fuel ratio is brought close to a predetermined air-fuel ratio;

means for changing a control amount in accordance with the output of said sub air-fuel ratio sensor; and means for controlling an electric power supplied to said electric heater in accordance with said control amount.

2. An apparatus as set forth in claim 1, wherein said control amount is a resistance value of said electric heater, said control amount changing means comprising:

means for lowering an aimed resistance value when the output of said sub air-fuel ratio sensor indicates a lean air-fuel ratio state; and means for raising said aimed resistance value when the output of said sub air-fuel ratio sensor indicates a rich air-fuel ratio state, said electric power controlling means controlling the electric power supplied to said electric power, so that the resistance value of said electric heater is brought close to the aimed resistance value.

3. An apparatus as set forth in claim 2, further comprising means for changing the aimed resistance value in accordance with mean values or blunt values of predetermined driving parameters of said engine.

4. An apparatus as set forth in claim 3, wherein said predetermined driving parameters of said engine are an intake air amount of said engine and a vehicle speed of a vehicle on which said engine is mounted.

5. An apparatus as set forth in claim 2, wherein said electric power controlling means comprises:

means for raising the duty ratio of the electric power when the resistance value of said electric heater is larger than the aimed resistance value; and means for lowering the duty ratio of said electric power when the resistance value of said electric heater is not larger than the aimed resistance value.

6. An apparatus as set forth in claim 1, wherein said control amount is an electric power supplied to said electric heater, said control amount changing means comprising:

means for lowering an aimed electric power when the output of said sub air-fuel ratio sensor indicates a lean air-fuel ratio state; and means for raising the aimed electric power when the output of said sub, air-fuel ratio sensor indicates a rich air-fuel ratio state, said electric power controlling means controlling the electric power supplied to the electric heater so that the electric power is brought close to the aimed electric power.

7. An apparatus as set forth in claim 6, further comprising means for changing the aimed electric power, in accordance with predetermined driving parameters of said engine.

8. An apparatus as set forth in claim 7, wherein said predetermined driving parameters of said engine are an intake air amount per one engine revolution of said engine and a vehicle speed of a vehicle on which said engine is mounted.

9. An apparatus as set forth in claim 8, further comprising means for correcting the aimed electric power in accordance with the temperature of intake air of said engine.

10. An apparatus as set forth in claim 6, wherein said electric power controlling means comprises:

means for raising the duty ratio of said electric power when the electric power is smaller than the aimed electric power; and means for lowering the duty ratio of the electric power when the electric power of said heater is not smaller than the aimed electric power.

11. An apparatus as set forth in claim 1, wherein said main air-fuel ratio sensor is disposed upstream of said catalyst converter.

12. An apparatus as set forth in claim 1, wherein said main air-fuel ratio sensor comprises a titania ($TiO_2$) type $O_2$ sensor, and said sub air-fuel ratio sensor comprises a zirconia type $O_2$ sensor.

* * * * *